US005372760A

United States Patent [19]

Wellenhofer et al.

[11] Patent Number: 5,372,760

[45] Date of Patent: Dec. 13, 1994

[54] PROCESS FOR PRODUCING POLYARYLENE SULFIDE FIBER AND THEREBY OBTAINABLE POLYARYLENE SULFIDE MULTIFILAMENT YARN

[75] Inventors: Herbert Wellenhofer, Strassberg; Werner Bruckner, Kriftel; Andreas Fischer, Frankfurt am Main; Gerhard Leumer, Bobingen, all of Germany

[73] Assignee: Hoechst Aktiengesellschaft, Frankfurt, Germany

[21] Appl. No.: 79,987

[22] Filed: Jun. 18, 1993

[30] Foreign Application Priority Data

Jun. 18, 1992 [DE] Germany ..... 4219952

[51] Int. Cl.[5] ..... B29C 35/10; D01D 5/092; D01D 5/12; D02J 1/22

[52] U.S. Cl. ..... 264/25; 264/210.7; 264/210.8; 264/211.12; 264/235.6

[58] Field of Search ..... 264/25, 103, 210.7, 264/210.8, 211.12, 211.15, 235.6, 289.3, 289.6, 290.5, 290.7

[56] References Cited

U.S. PATENT DOCUMENTS

| | | | |
|---|---|---|---|
| 3,539,676 | 11/1970 | Polestak . | |
| 4,500,706 | 2/1985 | Mathis et al. | 528/502 |
| 4,645,825 | 2/1987 | Idel et al. | 264/210.7 X |
| 4,816,335 | 3/1989 | Kouyama et al. | 428/364 |
| 5,023,036 | 6/1991 | Lee et al. | 264/211.23 |
| 5,024,797 | 6/1991 | Anderheggen et al. | 264/143 |
| 5,178,813 | 1/1993 | Akatsu et al. | 264/210.7 |
| 5,215,819 | 6/1993 | Anderheggen et al. | 428/364 |

FOREIGN PATENT DOCUMENTS

| | | | |
|---|---|---|---|
| 58-18409 | 2/1983 | Japan . | |
| 01-229809 | 9/1989 | Japan | 264/210.7 |
| 1-239109 | 9/1989 | Japan . | |

OTHER PUBLICATIONS

Abstract of Europe 398,094 (Published Nov. 22, 1990).
Abstract of Europe 407,887 (Published Jan. 16, 1991).
Abstract of Europe 453,100 (Published Oct. 23, 1991).

*Primary Examiner*—Leo B. Tentoni
*Attorney, Agent, or Firm*—Connolly & Hutz

[57] ABSTRACT

A process for producing fiber from polyarylene sulfide, by melt spinning a polyarylene sulfide into a gas, cooling the spun filaments with a blown gas, taking the filaments off at a high speed, storing the spun filaments, drawing the spun filaments in two stages and after treatment stage, and immediately thereafter heat setting the drawn filaments. Fibers produced by the invention have excellent mechanical properties including tensile strength and transverse strength, and the process is very efficient.

19 Claims, No Drawings

PROCESS FOR PRODUCING POLYARYLENE SULFIDE FIBER AND THEREBY OBTAINABLE POLYARYLENE SULFIDE MULTIFILAMENT YARN

BACKGROUND OF THE INVENTION

1. Field of the Invention

The present invention relates to a novel process for producing fiber based on polyarylene sulfide and to thereby obtainable novel multifilament yarn based on polyarylene sulfide.

Polyarylene sulfides are, as will be known, polymers possessing excellent resistance to thermal degradation and a wide range of chemicals. Fibers from these polymers are already known; see for example EP-A-195,422, EP-A-398,094, EP-A-453,100 and JP-A-58-18,409.

2. Description of the Related Art

Specifically designed spinning and aftertreatment processes for producing such fibers are described for example in EP-A-102,536, JP-A-01-239,109 and U.S. Pat. No. 3,539,676. EP-A-102,536 and JP-A-01-239,109 specify spinning takeoff speeds of 900 to 1100 m/min and of not more than 1000 m/min respectively; by contrast, the subsequent drawing conditions are not more particularly specified. On the other hand, U.S. Pat. No. 3,539,676 stipulates spinning takeoff speeds of 20 to 3000 m/min and recommends that no additional drawing be carried out.

The multi-stage drawing of fiber based on polyarylene thioether is described for example in JP-A-01-229,809 and EP-A-398,094.

SUMMARY OF THE INVENTION

Against the background of these prior art processes, it is the object of the present invention to make available a fiber production process of high productivity whereby fiber having good mechanical properties can be produced in a simple manner, and particularly with as few drawing stages as possible.

It has now been found, surprisingly, that fiber having very good mechanical properties, such as tensile strength and transverse strength as measured for example in the loop and knot strength, can be produced with high productivity by spinning at high takeoff speeds and carrying out the subsequent drawing in two stages under specific conditions.

The present invention accordingly provides a process for producing fiber from polyarylene sulfide comprising the steps of:

a) melt spinning a fiber-forming polyarylene sulfide into a gas, in particular into air, at a pump rate of at least 0.5 g/(min×hole), b) forcedly cooling the spun filaments in the spinning column by quenching with a blown gas, c) taking off the filaments at a speed of more than 800 m/min, preferably between 1000 and 5000 m/min, d) intermediately storing the spun filaments, e) drawing the spun filaments in two stages in an aftertreatment stage by e1) drawing in the first stage at a temperature between the glass transition temperature and the yield temperature to such a degree that the filaments are virtually completely drawn and e2) drawing in the second stage at a temperature above that of the first stage and below the crystallite melting point temperature of the filaments to such a degree that the filaments are additionally drawn by 5 to 30% and in such a way that no mechanical contact is involved in the heat transfer of the second drawing stage and the drawing tension is 11 to 25 cN/tex, based on the true linear density, and f) immediately thereafter heat setting the drawn filaments.

Suitable polyarylene sulfide for use in the process of the invention is any fiber-forming polymer having in the main the recurring structural unit of the formula I where Ar is a bivalent monocyclic or polycyclic aromatic radical whose free valences are disposed para or meta or in a comparable parallel or angled position. The polymer can also be a partially crosslinked structure, provided it is spinnable under the above-defined conditions.

It is also possible to use mixtures of polyarylene sulfide polymers or polyarylene sulfide polymers which have different recurring structural units of the formula I in one molecule. Examples of mixtures of polyarylene sulfides are mentioned in EP-A-407,887, incorporated herein by reference.

Preferably the polyarylene sulfide used is a polyphenylene sulfide, in particular a polymer in which Ar is p-phenylene.

Preferred polyphenylene sulfides have at 320° C. a 1000 $sec^{-1}$ shear rate melt viscosity ($MV_{1000}$) of from 60 to 150 Pas and a 3000 $sec^{-1}$ shear rate melt viscosity ($MV_{3000}$) of more than 50 Pas. The difference between $MV_{1000}$ and $MV_{3000}$ can be more than 20 Pas, in contradistinction to the requirements of JP-A-01-239,109.

Prior to spinning, the polyarylene sulfide is usually subjected to a drying process. For this the polymer is in general in a finely divided form, such as powder or granule form and in particular in the form of chips, and the drying is preferably carried out under reduced pressure. The usual drying times are between 6 and 10 hours. The drying temperature is usually from 120 to 160° C. However, the drying can also be carried out under an inert gas.

Particular preference is given to using a polyarylene sulfide whose water content is not more than 0.01%, measured by the method of Karl Fischer. This raw material makes it possible to obtain particularly stable spinning conditions.

In the process of the invention, the polyarylene sulfide is melt spun, for which the conventional apparatus for spinning such polymer can be used. Spinning takes place in a column into a gas, in particular into air or else into an inert gas such as nitrogen.

What is important here is that the pump rate should be at least 0.5 g/(min×hole). Particularly preferred pump rates range from 0.7 to 1.3 g/(min×hole).

The temperatures in the spinning jet usually range from 280° to 320° C., preferably from 290° to 315° C.

Any desired spinning jet can be used. The number of holes in the jet is typically within the range from 100 to 500. The jet hole shape is likewise readily choosable and can be for example triangular, rectangular, multilobal, oval or in particular round. Typical jet hole diameters range from 0.20 to 0.65 mm.

Preferably the holes in the jet are arranged in the form of concentric rings.

After extrusion from the jet the filaments are subjected to forced cooling in the spinning column by quenching with a blown gas. Any conventional form of quench can be used. Not only transverse quenching is possible but in particular central quenching. In particular the central quench from in to out is preferred. The gas used can be an inert gas, such as nitrogen. Air is preferred.

The speed of the filaments leaving the spinning column is more than 800 m/min, preferably between 1000 and 5000 m/min, in particular from 1000 to 2000 m/min.

The filaments leaving the spinning column advantageously have applied to them a customary spin finish as they emerge from the spinning column or shortly before or after. However, the finish can also be applied elsewhere on the production line. The application of the finish can be effected by any means known for that purpose, for example by spraying or with the aid of a lick roller.

After the spun filaments have left the spinning column with or without a spin finish, the process is interrupted and the spun filaments are brought into a suitable form for intermediate storage. For this purpose they can be canned or in particular wound up. Intermediate storage has the purpose, inter alia, of reducing the feed speed into the aftertreatment stage and of uniformizing the spun material. The length of time of intermediate storage varies for example within the range from hours to days. This part of the process can be used to apply intermediate treatments to the spun multifilament yarns, for example heat treating the wound fiber.

The aftertreatment of the intermediately stored filaments comprises two-stage drawing under particular conditions and subsequent heat setting.

The first drawing stage is carried out at a temperature between the glass transition temperature and the yield temperature of the filaments, for example between 80° and 120° C., to such a degree that the filaments are virtually completely drawn. Preferred temperatures for this drawing stage vary from 100° to 120° C.

As used herein "virtually completely drawn" is to be understood as meaning that the degree to which the filaments are drawn amounts to at least 70% of the maximum degree of drawing achievable for the multifilament yarn in question. The maximum achievable degree of drawing can be determined for any specific combination of multifilament yarn/spin finish by measuring the yield points at various temperatures.

The first drawing stage can be carried out using various suitable apparatus, for example by means of rolls combined with a liquid bath or with hot plates or pins, but in particular over heated godets.

Typical draw ratios for this stage range from 1:2.5 to 1:5, preferably from 1:2.5 to 1:3.5.

The second drawing is carried out at a temperature above that of the first stage and below the crystallite melting point temperature of the filaments and to such a degree that the filaments are additionally drawn by from 5 to 30% and no mechanical contact is involved in the heat transfer of the second drawing stage. The drawing tension in this stage is set to 11–25 cN/tex, based on the true linear density. It is particularly advantageous for this stage to employ a very high drawing temperature.

As used herein "drawing tension based on the true linear density" is to be understood as meaning the specific tension which is obtained on dividing the yarn tension at that point by the linear density at that point.

The temperature of this stage is preferably between 160° and 260° C., in particular between 200° and 240° C.

The second drawing stage is carried out in such a way that, apart from the transport godets at the start and the end, the multifilament yarn does not come into contact with any component of the drawing unit during the drawing process. To this end, drawing is advantageously carried out contactlessly in a heating oven, preferably in a hot air duct or in an infrared duct, as described for example in EP-A-398,094.

Typical draw ratios for this stage range from 1:1.05 to 1:1.3, preferably from 1:1.1 to 1:1.25.

It was surprisingly found that the yarns thus produced can immediately thereafter be heat set. Heat setting can be carried out in any number of ways, but it is preferable to allow the yarn to shrink. The heat setting temperature is usually about 210°–300° C. Typical degrees of shrinkage range from 2 to 10%. Heat setting can likewise be carried out contactlessly, but is preferably carried out over heated godets.

Preferred setting temperatures range from 230° to 300° C. and the setting tension is in particular less than 10 cN/tex, based on the true linear density. Preferably the setting tension is less than 7 cN/tex.

After setting, the filaments obtained are either wound up or cut in a conventional manner into staple fiber.

The multifilament yarns obtainable by the process of the invention are notable for a high transverse strength. The invention accordingly also provides polyarylene sulfide fiber having a tensile strength of more than 40 cN/tex, in particular from 45 to 50 cN/tex, and a transverse strength of more than 65% of the tensile strength, in particular of from 70 to 80% of the tensile strength.

The multifilament yarns of the invention generally have a linear density of from 200 to 1100 dtex.

Since the multifilament yarns of the invention have the above-described advantageous combination of properties, they are readily twistable.

The examples which follow illustrate the invention without limiting it.

EXAMPLES 1 TO 4

Production of Multifilament Yarn from p-polyphenylene Sulfide (PPS)

p-Phenylene sulfide is melt spun into filaments which are taken off at 1000 m/min, spin finished and wound up. The filaments obtained are then drawn twice, the first drawing stage being carried out over heated godets and the second drawing stage with the filaments being guided contactlessly in an infrared duct. On leaving this duct the drawn filaments are set, a defined amount of shrinkage being allowed using godets. They are then wound up on bobbins. In Comparative Example 4 the heat setting shrinkage is replaced by additional drawing. The table below indicates the process parameters and properties of the PPS multifilament yarns obtained.

The quantities are measured as follows:

Linear density in accordance with DIN 53830 Part 1
Tenacity in accordance with DIN 53834 Part 1
Extension in accordance with DIN 53834 Part 4
Hot air shrinkage on the lines of DIN 53866
Loop strength in accordance with DIN 53843 Part 1

TABLE

| Example No. | 1 | 2 | 3 | (comparison) 4 |
|---|---|---|---|---|
| Spinning temp. (°C.) | 296 | 296 | 296 | |
| Pump rate/hole g/(min × hole) | 1.02 | 1.02 | 1.02 | |
| Jet hole | 0.45 | 0.45 | 0.45 | |

TABLE -continued

| Example No. | 1 | 2 | 3 | (comparison) 4 |
|---|---|---|---|---|
| diameter (mm) | | | | |
| Draw ratio Stage 1 (1:) | 3.30 | 3.30 | 3.20 | 3.26 |
| Temperature[1)] Stage 1 (°C.) | 105 | 105 | 105 | 100 |
| Drawing tension (cN/tex) | 6.3 | 6.3 | 5.3 | |
| Draw ratio Stage 2 (1:) | 1.23 | 1.23 | 1.24 | 1.36 |
| Temperature[2)] Stage 2 (°C.) | 220 | 220 | 220 | 260 |
| Drawing tension (cN/tex) | 15.3 | 15.3 | 15.2 | |
| Shrinkage/ stretching in setting (1:) | 0.98 | 0.96 | 0.93 | 1.15 |
| Total linear density (dtex) | 563 | 560 | 563 | 200 |
| Tenacity (cN/tex) | 49.4 | 50.3 | 48.7 | 60.4 |
| Breaking extension (%) | 13.5 | 14.2 | 17.2 | 18.3 |
| Shrinkage at 200° C. (%) | 8.6 | 7.3 | 4.3 | 10.6 |
| Transverse strength (%) | 76 | 73.6 | 74.5 | 61 |

[1)]Temperature of takeoff godet
[2)]Air temperature in infrared duct

What is claimed is:

1. A process for producing fiber from polyarylene sulfide comprising the steps of:

a) melt spinning a polyarylene sulfide in a spinning column into a gas at a pump rate of at least 0.5 g/(min×hole), b) forcedly cooling the spun filaments in the spinning column by quenching with a blown gas, c) taking off the filaments at a speed of more than 800 m/min, d) intermediately storing the spun filaments, e) drawing the spun filaments in two stages in an after treatment state by e1) drawing in the first stage at a temperature between the glass transition temperature and the yield temperature to such a degree that the filaments are virtually completely drawn and e2) drawing in the second stage at a temperature above that of the first stage and below the crystallite melting point temperature of the filaments to such a degree that the filaments are additionally drawn by 5 to 30% and in such a way that no mechanical contact is involved in the heat transfer of the second drawing stage, and the drawing tension is 11 to 25 cN/tex, based on the true linear density, and f) immediately thereafter heat setting the drawn filaments.

2. The process of claim 1, wherein the polyarylene sulfide used is in the form of chips and has a water content of not more than 0.01%, measured by the method of Karl Fischer.

3. The process of claim 1, wherein the spinning take-off speed is from 1000 to 2000 m/min.

4. The process of claim 1, wherein the freshly spun filaments are wound up and intermediately stored as a wound package.

5. The process of claim 1, wherein the freshly spun filaments are deposited in cans and intermediately stored therein.

6. The process of claim 1, wherein the spinning jets have more than 100 holes.

7. The process of claim 1, wherein the first drawing stage e1) is carried out over heated godets.

8. The process of claim 1, wherein the first drawing stage e1) is carried out at temperatures of less than 150° C.

9. The process of claim 1, wherein the second drawing stage e2) is carried out at temperatures between 160° and 260° C.

10. The process of claim 1, wherein the second drawing stage e2) is carried out contactlessly in a heating oven.

11. The process of claim 1, wherein the first drawing e1) is carried out at about 100°–120° C. using a drawing tension of from 7 to 10 cN/tex and a draw ratio of about 2.5–3.5 and the second drawing e2) is carried out in such a way as to produce a total draw ratio of about 3–5 and at a temperature above 200° C. and at a tension between 11 and 25 cN/tex, based on the true linear density.

12. The process of claim 1, wherein the heat setting f) is carried out with an allowed shrinkage of from 2 to 10%, temperatures of from 210° to 300° C. and tensions of below 10 cN/tex, based on the true linear density.

13. The process of claim 1, wherein the setting of the drawn filaments is carried out continuously over heated godets or in a heating oven.

14. A process for producing fiber from polyarylene sulfide as claimed in claim 1, wherein the gas into which the melt spinning of polyarylene sulfide occurs in step a) is air.

15. A process for producing fiber from polyarylene sulfide as claimed in claim 1, wherein the taking off speed of the filaments in step c) is between 1000 and 5000 m/min.

16. The process as claimed in claim 8, wherein the first drawing stage e1) is carried out at temperatures of between 100° and 120° C.

17. The process as claimed in claim 9, wherein the second drawing stage e2) is carried out at temperatures of between 200° and 240° C.

18. The process as claimed in claim 6, wherein the spinning jets are arranged in concentric circles.

19. The process as claimed in claim 10, wherein the second drawing stage e2) is carried out in a hot air duct or in an infrared duct.

* * * * *